US010273699B2

(12) United States Patent
Itagaki

(10) Patent No.: US 10,273,699 B2
(45) Date of Patent: Apr. 30, 2019

(54) BINDING MACHINE

(71) Applicant: MAX CO., LTD., Chuo-ku, Tokyo (JP)

(72) Inventor: Osamu Itagaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 15/847,642

(22) Filed: Dec. 19, 2017

(65) Prior Publication Data

US 2018/0187430 A1 Jul. 5, 2018

(30) Foreign Application Priority Data

Dec. 29, 2016 (JP) ..... 2016-257452

(51) Int. Cl.

| | |
|---|---|
| ***B21F 15/04*** | (2006.01) |
| ***E04G 21/12*** | (2006.01) |
| ***B65B 13/28*** | (2006.01) |
| *B21F 23/00* | (2006.01) |

(52) U.S. Cl.

CPC ..... *E04G 21/123* (2013.01); *B21F 15/04* (2013.01); *B65B 13/285* (2013.01); *B21F 23/005* (2013.01)

(58) Field of Classification Search

CPC ..... B65B 13/025; B65B 13/027; B65B 13/28; B65B 13/285; B65B 13/22; B65H 59/04; B21F 9/02; B21F 15/00; B21F 15/02; B21F 23/00; B21F 23/005; B21F 33/00; B21F 15/04; E04G 21/122; E04G 21/123

See application file for complete search history.

(56) References Cited

U.S. PATENT DOCUMENTS

| | | | | |
|---|---|---|---|---|
| 7,140,400 | B2 * | 11/2006 | Yokochi | B65B 13/025 140/119 |
| 8,127,803 | B2 * | 3/2012 | Kusakari | E04G 21/122 140/123.6 |
| 8,567,310 | B2 | 10/2013 | Yi | |
| 2004/0244866 | A1 | 12/2004 | Ishikawa et al. | |
| 2006/0011254 | A1 | 1/2006 | Yokochi et al. | |

FOREIGN PATENT DOCUMENTS

| | | | |
|---|---|---|---|
| CN | 1688481 | A | 10/2005 |
| EP | 1 557 359 | A1 | 7/2005 |
| JP | 4729822 | B2 | 7/2011 |
| WO | 2010/092337 | A1 | 8/2010 |

OTHER PUBLICATIONS

Extended European Search Report dated Feb. 2, 2018 in corresponding EP Patent Application No. 17208767.8 (8 pages).

* cited by examiner

*Primary Examiner* — Pradeep C Battula
(74) *Attorney, Agent, or Firm* — Rothwell, Figg, Ernst & Manbeck, P.C.

(57) ABSTRACT

A binding machine includes a wire feeding unit configured to feed a wire to be wound on an object to be bound and a binding unit configured to twist the wire wound on the object to be bound. The wire feeding unit includes a pair of feeding members configured to sandwich the wire between the pair of feeding members and to feed the wire by a rotating operation, a wire feeding drive unit connected to one feeding member and configured to rotatively drive the one feeding member, and a load reducing part configured to reduce or remove a load, which is to be applied to the wire via the one feeding member, of the wire feeding drive unit.

10 Claims, 13 Drawing Sheets

BINDING MACHINE

CROSS-REFERENCE TO RELATED APPLICATION

This application claims the priority from Japanese Patent Application No. 2016-257452 filed on Dec. 29, 2016, the entire contents of which are incorporated herein by reference.

FIELD

The present disclosure relates to a binding machine configured to bind an object to be bound such as a reinforcing bar with a wire.

BACKGROUND

In the related art, a binding machine called as a reinforcing bar binding machine configured to wind a wire on two or more reinforcing bars, and to bind the two or more reinforcing bars with the wire by twisting the wire wound on the reinforcing bars has been suggested.

The binding machine includes a wire feeding unit configured to feed a wire, a curl guide unit configured to curl the wire fed by the wire feeding unit around reinforcing bars, and a binding unit configured to twist the wire curled by the curl guide unit and to bind the reinforcing bars. When binding the reinforcing bars by the binding machine, the wire is first mounted (set) to the wire feeding unit. Then, the wire feeding unit is driven to feed the wire toward a curl forming part, and the wire is curled at the curl forming part, is twisted at the binding unit and binds the reinforcing bars.

The wire feeding unit includes a pair of spur gear-shaped feeding members disposed so that outer peripheral teeth (outer peripheral surfaces) thereof face each other. The pair of feeding members can be disposed so that the outer peripheral teeth thereof can be meshed with each other, and is configured so that when one feeding member (drive-side feeding member) is rotated, the other feeding member (driven-side feeding member) is also rotated. In the meantime, the drive-side feeding member is rotated by a motor via a gear and the like (for example, refer to Japanese Patent No. 4,729,822B and U.S. Pat. No. 8,567,310B).

The outer peripheral surfaces of the feeding members are formed with grooves in a circumferential direction.

When mounting the wire to the wire feeding unit (when sandwiching the wire by the pair of feeding members), the wire is set to the grooves of the outer peripheral surfaces and the feeding members are moved to positions at which the outer peripheral teeth thereof are meshed with each other.

When mounting the wire to the wire feeding unit, the driven-side feeding member is moved (opened) away from the drive-side feeding member so as to easily mount the wire, so that a space for mounting the wire is secured between the feeding members.

As described above, when setting the wire between the feeding members, only the driven-side feeding member is moved. Therefore, the drive-side feeding member still exists on a feeding path of the wire or at a position closely adjacent to the feeding path of the wire. For this reason, when mounting the wire, the drive-side feeding member gets in the way, so that a tip end portion of the wire may collide with (be caught at) the drive-side feeding member. When the tip end portion of the wire collides with the drive-side feeding member, it is difficult to mount the wire. In some cases, the wire may not be appropriately mounted.

The present disclosure has been made in view of the above situations, and an object thereof is to provide a binding machine capable of easily and securing mounting a wire.

In order to accomplish the above object, the present disclosure provides a binding machine including a wire feeding unit configured to feed a wire to be wound on an object to be bound, and a binding unit configured to twist the wire wound on the object to be bound, wherein the wire feeding unit includes a pair of feeding members configured to sandwich the wire therebetween and to feed the wire by a rotating operation, a wire feeding drive unit connected to one of the feeding members and configured to rotatively drive the one feeding member, and a load reducing part configured to reduce or remove a load of the wire feeding drive unit, which is to be applied to the wire via the one feeding member.

According to the present disclosure, the load of the wire feeding drive unit, which is to be applied to the wire via one feeding member, is reduced or removed, so that one feeding member does not interfere with the mounting of the wires when mounting the wire between the pair of feeding members.

DETAILED DESCRIPTION

Hereinafter, an example of a reinforcing bar binding machine, which is an embodiment of the binding machine of the present disclosure, will be described with reference to the drawings.

<Example of Configuration of Reinforcing Bar Binding Machine of Embodiment>

Figure 1:
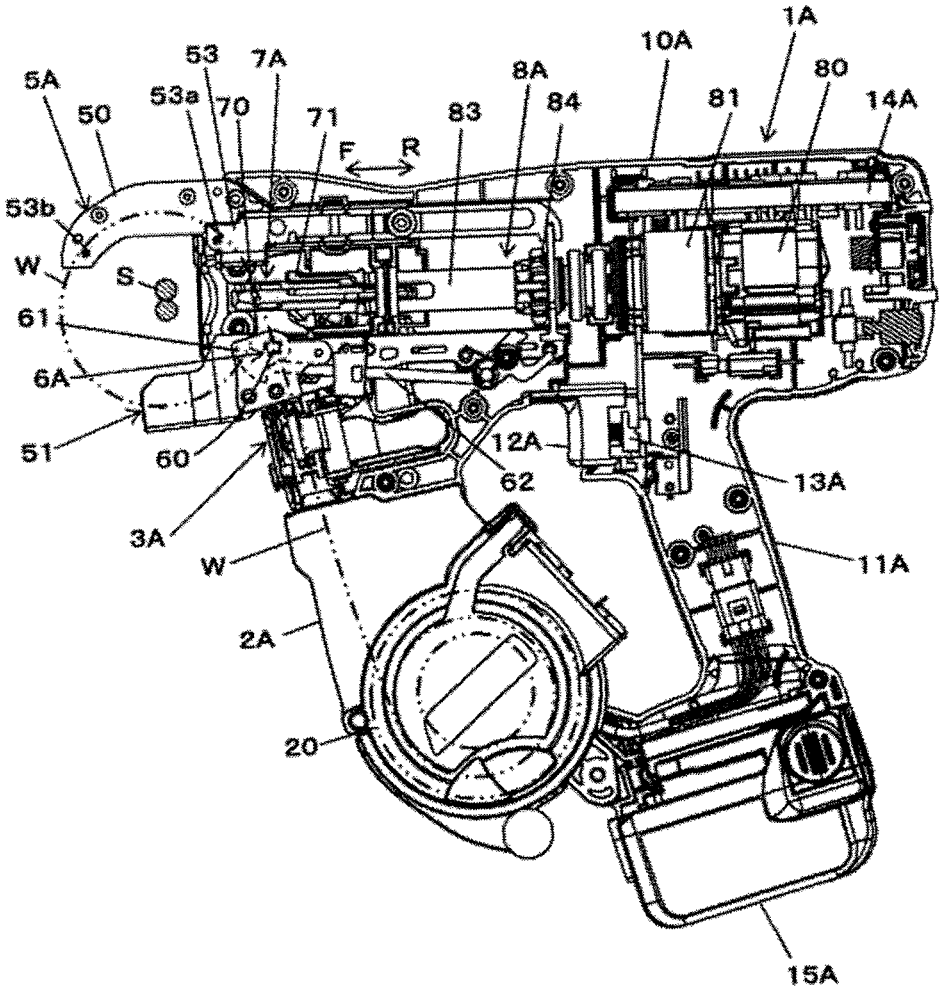
FIG. 1 is a view depicting an example of an entire configuration of a reinforcing bar binding machine of an embodiment, as seen from a side.
Figure 2:
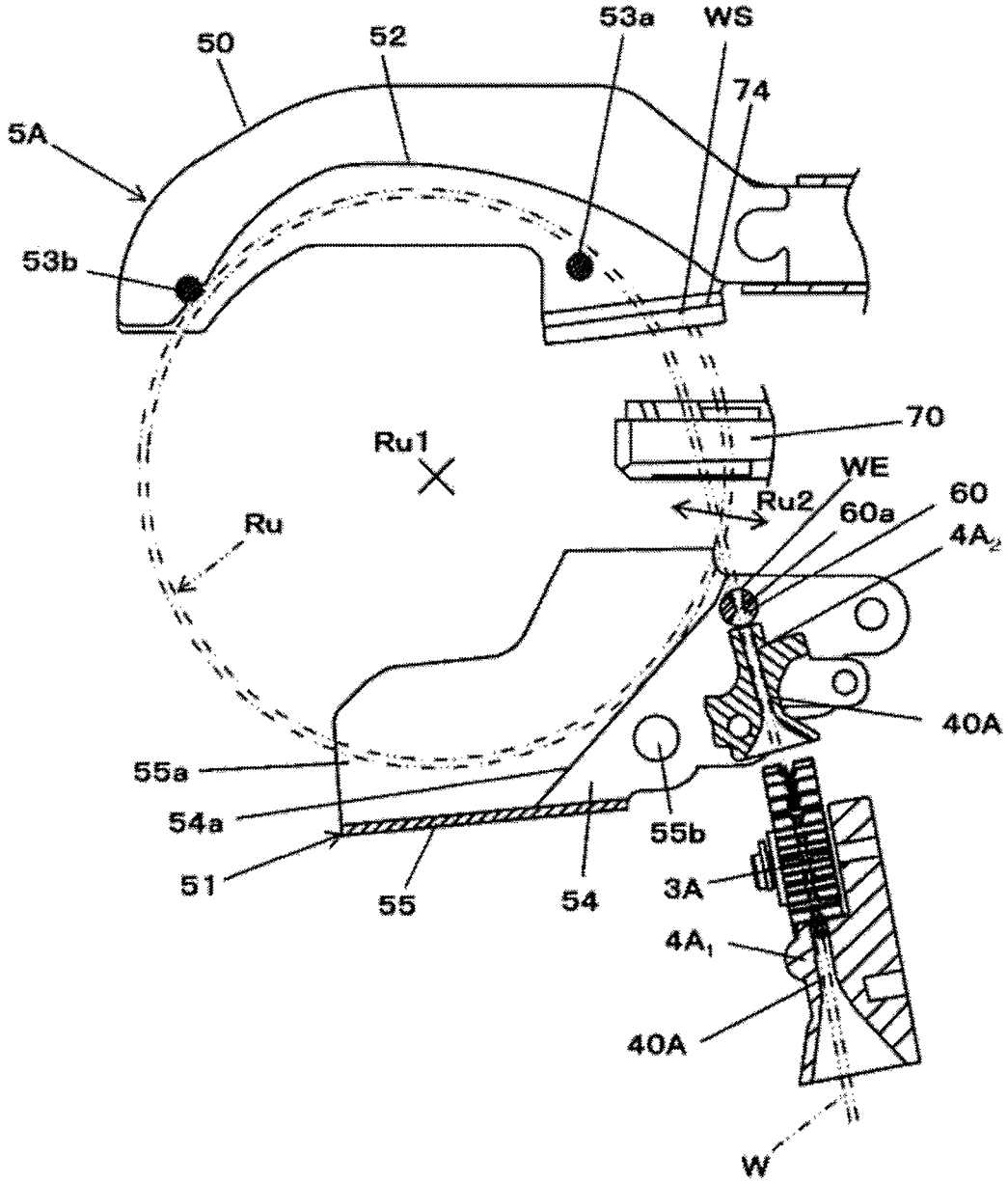
FIG. 2 is a view depicting an example of a main configuration of the reinforcing bar binding machine of the embodiment, as seen from a side.

FIG. 1 is a view depicting an example of an entire configuration of a reinforcing bar binding machine of an embodiment, as seen from a side, and FIG. 2 is a view depicting an example of a main configuration of the reinforcing bar binding machine of the embodiment, as seen from a side.

A reinforcing bar binding machine 1A of an embodiment is configured to feed wire W in a forward direction, which is one direction, to wind the wires around reinforcing bars S, which are an object to be bound, and then, to pull back the wire in a reverse direction to the forward direction and to wind the wire on the reinforcing bars S. The reinforcing bar binding machine 1A is also configured to grip and twist a part of the wire W wound on the reinforcing bars S, thereby binding the reinforcing bars S with the wire W.

The reinforcing bar binding machine 1A includes a magazine 2A, which is an accommodation unit configured to accommodate therein the wire W, a wire feeding unit 3A configured to feed the wire W, a curl guide unit 5A configured to form a path along which the wire W fed by the wire feeding unit 3A are to be wound around the reinforcing bars S, a cutting unit 6A configured to cut the wire W wound on the reinforcing bars S, and a binding unit 7A configured to twist the wire W wound on the reinforcing bars S.

Also, the reinforcing bar binding machine 1A includes a first wire guide $4A_1$ provided upstream of the wire feeding unit 3A with respect to the feeding of the wire W in the forward direction and configured to guide the wire W, which are to be fed into the wire feeding unit 3A.

The reinforcing bar binding machine 1A includes a second wire guide $4A_2$ provided downstream of the wire feeding unit 3A with respect to the feeding of the wire W in the forward direction and configured to guide the wire W, which are to be delivered from the wire feeding unit 3A.

A reel 20 on which the long wire W is wound to be reeled out is rotatably and detachably accommodated. In the reinforcing bar binding machine 1A of the embodiment, the two wires W are wound to be reeled out on the reel 20 so that the reinforcing bars S can be bound with the two wires W.

A wire made of a plastically deformable metal wire, a wire having a metal wire covered with a resin, a twisted wire or the like can be used as the wire W.

Figure 3:
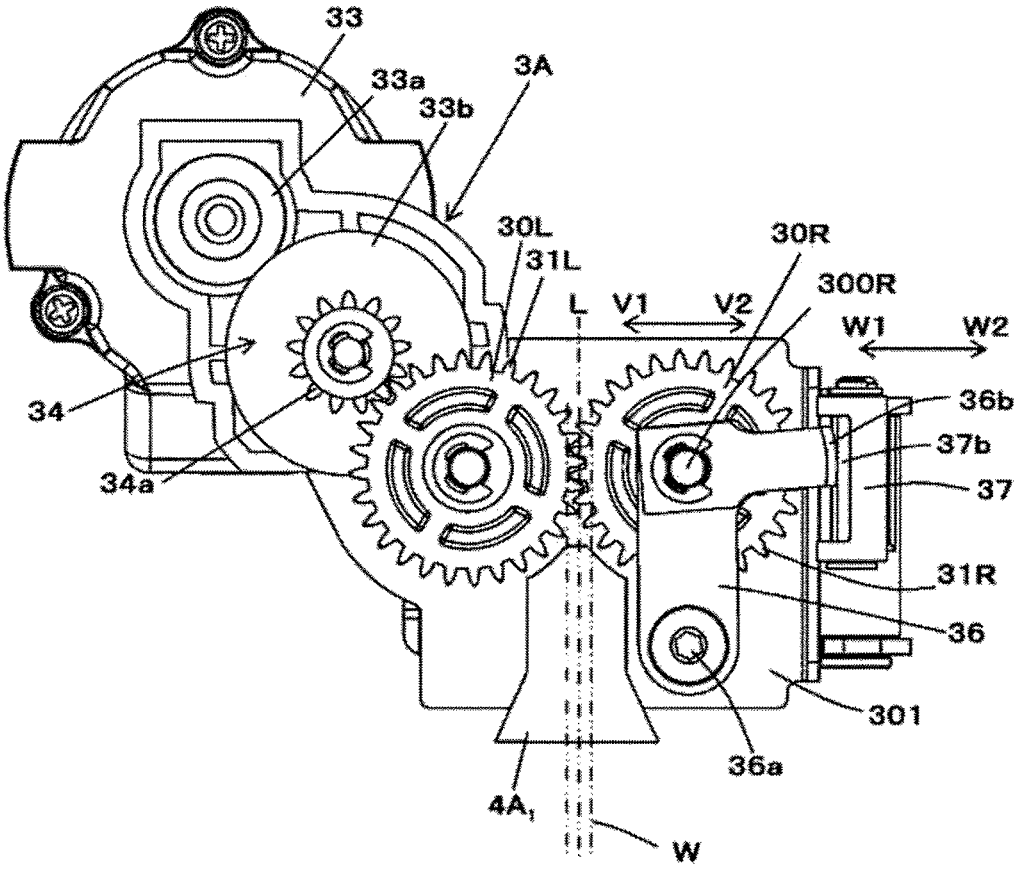
FIG. 3 is a view depicting an example of a wire feeding unit.
Figure 4:
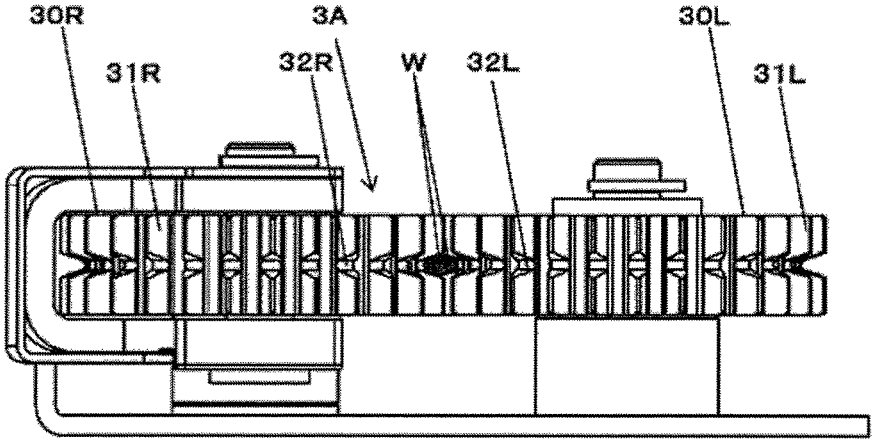
FIG. 4 is a view depicting the example of the wire feeding unit.

FIGS. 3 and 4 depict an example of the wire feeding unit.

Subsequently, a configuration of the wire feeding unit 3A is described. The wire feeding unit 3A includes a first feeding gear 30L and a second feeding gear 30R configured to feed the wire W by a rotating operation. The first feeding gear 30L and the second feeding gear 30R are a pair of feeding members configured to sandwich and feed two wires W aligned in parallel.

The first feeding gear 30L has a tooth part 31L configured to transmit a drive force. In this example, the tooth part 31L has a spur gear shape, and is formed on an entire circumference of an outer periphery of the first feeding gear 30L. Also, the first feeding gear 30L has a groove portion 32L into which the wire W enters. In this example, the groove portion 32L is a concave portion of which a sectional shape is a substantial V shape, and is formed on the entire circumference of the outer periphery of the first feeding gear 30L along a circumferential direction.

The second feeding gear 30R has a tooth part 31R configured to transmit a drive force. In this example, the tooth part 31R has a spur gear shape, and is formed on an entire circumference of an outer periphery of the second feeding gear 30R. Also, the second feeding gear 30R has a groove portion 32R into which the wire W enters. In this example, the groove portion 32R is a concave portion of which a sectional shape is a substantial V shape, and is formed on the entire circumference of the outer periphery of the second feeding gear 30R along a circumferential direction.

The first feeding gear 30L and the second feeding gear 30R are provided with the feeding path of the wire W being interposed therebetween so that the groove portion 32L and the groove portion 32R are arranged to face each other.

The first feeding gear 30L and the second feeding gear 30R are pressed so that the first feeding gear 30L and the second feeding gear 30R come close to each other so as to sandwich the wire W therebetween. Thereby, the wire feeding unit 3A sandwiches the wire W between the groove portion 32L of the first feeding gear 30L and the groove portion 32R of the second feeding gear 30R.

Also, at a state where the wire W is sandwiched between the groove portion 32L of the first feeding gear 30L and the groove portion 32R of the second feeding gear 30R, the tooth part 31L of the first feeding gear 30L and the tooth part 31R of the second feeding gear 30R are meshed with each other. Thereby, the drive force is transmitted between the first feeding gear 30L and the second feeding gear 30R by rotation.

The wire feeding unit 3A includes a feeding motor 33, and a drive force transmission mechanism 34 configured to transmit a drive force of the feeding motor 33 to the first feeding gear 30L.

The feeding motor 33 is an example of the wire feeding drive unit configured to drive one of the first feeding gear 30L and the second feeding gear 30R. In this example, the feeding motor 33 is configured to drive the first feeding gear 30L.

The drive force transmission mechanism 34 includes a small gear 33*a* mounted to a shaft of the feeding motor 33 and a large gear 33*b* configured to mesh with the small gear 33*a*. Also, the drive force transmission mechanism 34 includes a feeding small gear 34*a*, which the drive force is transmitted thereto from the large gear 33*b* and is configured to mesh with the first feeding gear 30L. The small gear 33*a*, the large gear 33*b* and the feeding small gear 34*a* are respectively configured by a spur gear.

The first feeding gear 30L is configured to rotate as a rotating operation of the feeding motor 33 is transmitted thereto via the drive force transmission mechanism 34. The second feeding gear 30R is configured to rotate in conjunction with the first feeding gear 30L as a rotating operation of the first feeding gear 30L is transmitted thereto through engagement between the tooth part 31L and the tooth part 31R.

Thereby, the wire feeding unit 3A is configured to feed the wire W sandwiched between the first feeding gear 30L and the second feeding gear 30R along the extension direction of the wire W. In the configuration of feeding the two wires W, the two wires W are fed with being aligned in parallel by a frictional force that is to be generated between the groove portion 32L of the first feeding gear 30L and one wire W, a frictional force that is to be generated between the groove portion 32R of the second feeding gear 30R and the other wire W, and a frictional force that is to be generated between one wire W and the other wire W.

The wire feeding unit 3A is configured so that the rotation directions of the first feeding gear 30L and the second feeding gear 30R are switched and the feeding direction of the wire W is switched between the forward and reverse directions by switching the rotation direction of the feeding motor 33 between the forward and reverse directions.

Figure 5:
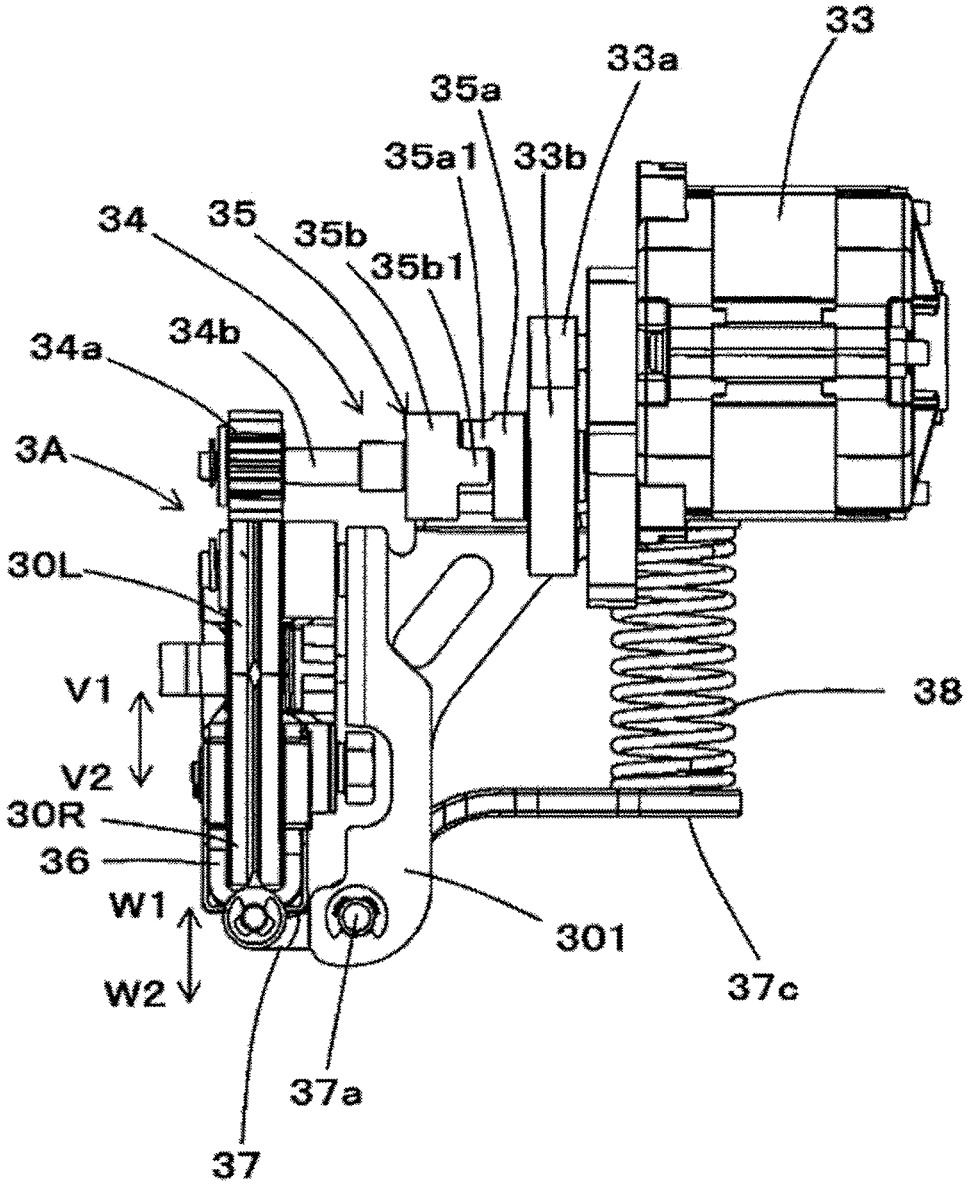
FIG. 5 is a view depicting the wire feeding unit in detail.
Figure 6:
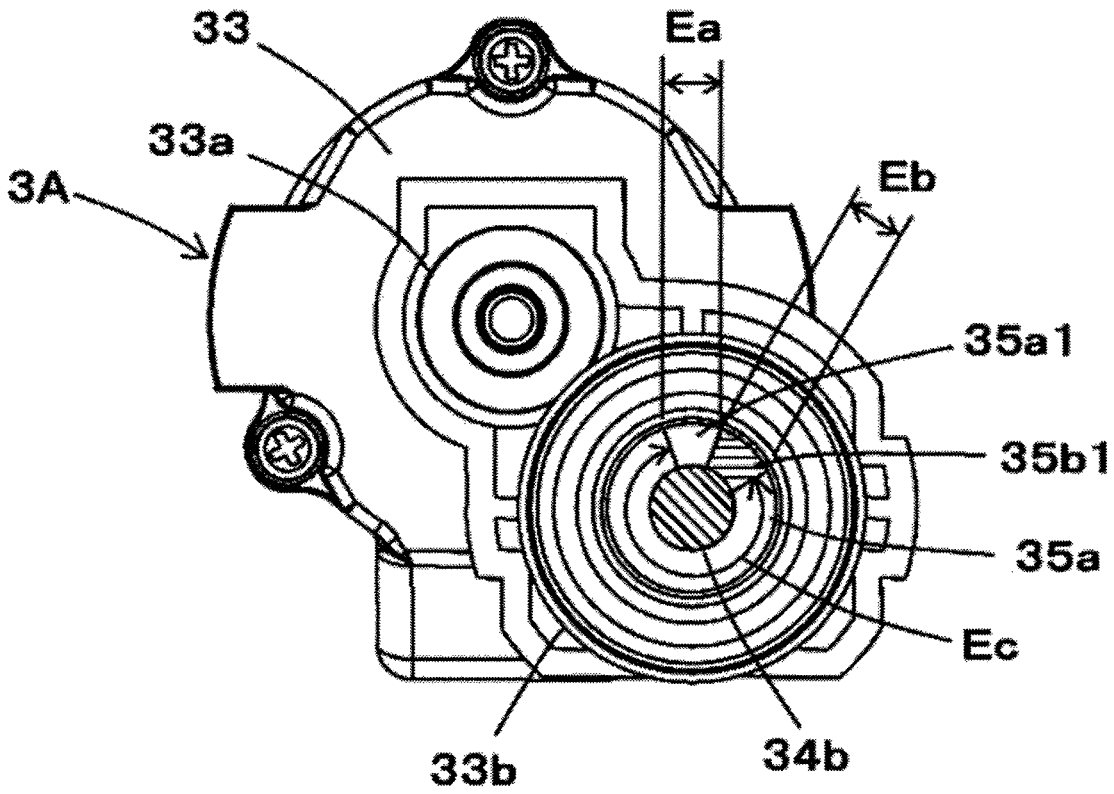
FIG. 6 is a view depicting the wire feeding unit in detail.

FIGS. 5 and 6 depict the wire feeding unit of the embodiment in detail. In the below, an example of the configuration of switching whether or not to transmit the drive force via the first feeding gear 30L between the wire W and the feeding motor 33 so as to easily and securely mount the wire W is described.

The wire feeding unit 3A is configured to switch whether or not to transmit the drive force from the feeding motor 33 to the first feeding gear 30L, thereby switching whether or not to transmit the drive force via the first feeding gear 30L between the wire W and the feeding motor 33.

Therefore, the drive force transmission mechanism 34 includes a clutch 35 configured to connect and disconnect the drive force from the feeding motor 33 to the first feeding gear 30L. The clutch 35 is configured to reduce or remove a load of the feeding motor 33, which is to be applied to the wire W via the first feeding gear 30L.

The clutch 35 is an example of the load reducing part, and is configured to switch between a drive force transmission state where the feeding small gear 34*a* rotates in conjunction with the large gear 33*b* and a drive force cutoff state where the feeding small gear 34*a* freely rotates relative to the large gear 33*b*.

In this example, in order to implement the above function, the clutch 35 has a coupling part 35*a* that is to be mounted to a shaft of the large gear 33*b* and a coupled part 35*b* that is to be mounted to a feeding gear shaft 34*b* of the feeding small gear 34*a*. The coupling part 35*a* is configured to rotate integrally with the large gear 33*b* by the rotating operation about the shaft of the large gear 33*b*. Also, the coupled part 35*b* is configured to rotate integrally with the feeding small gear 34*a* by the rotating operation about the feeding gear shaft 34*b* of the feeding small gear 34*a*.

The coupling part 35*a* is arranged coaxially with the large gear 33*b*. Also, the coupled part 35*b* is arranged coaxially with the feeding small gear 34*a*. The feeding small gear 34*a* and the large gear 33*b* are coaxially arranged at a state where the feeding gear shaft 34*b* of the feeding small gear 34*a* and a shaft (not shown) of the large gear 33*b* are spaced with each other in the axial direction (lateral direction in FIG. 5). Thereby, the coupling part 35*a* and the coupled part 35*b* are arranged coaxially with the large gear 33*b* and the feeding gear shaft 34*b*, and the coupling part 35*a* and the coupled part 35*b* face each other in axial directions thereof.

The coupling part 35*a* has a coupling convex portion 35*a*1 formed on a surface facing the coupled part 35*b*. The coupling convex portion 35*a*1 protrudes toward the coupled part 35*b*. Also, the coupled part 35*b* has a coupled convex portion 35*b*1 formed on a surface facing the coupling part 35*a*. The coupled convex portion 35*b*1 protrudes toward the coupling part 35*a*.

The coupling convex portion 35*a*1 is provided at a position distant in the radial direction from a center of the rotating operation of the coupling part 35*a* by a predetermined distance. The coupling convex portion 35*a*1 passes a locus distant from the center of the rotating operation of the coupling part 35*a* by the predetermined distance during the rotating operation of the coupling part 35*a*. The coupling convex portion 35*a*1 has a circumferential width Ea narrower than an entire circumference of the coupling part 35*a* in a circumferential direction.

The coupled convex portion 35*b*1 is provided at a position distant in the radial direction from a center of the rotating operation of the coupled part 35*b* by a predetermined distance. The coupled convex portion 35*b*1 is located on the locus of the coupling convex portion 35*a*1, which is made by the rotating operation of the coupling part 35*a*. The coupled convex portion 35*b*1 has a circumferential width Eb narrower than an entire circumference of the coupled part 35*b* in the circumferential direction.

That is, the coupling convex portion 35*a*1 and the coupled convex portion 35*b*1 are overlapped with each other in the axial and radial directions. Therefore, the coupling convex portion 35*a*1 is located on the moving locus of the coupled convex portion 35*b*1 in the circumferential direction, and the coupled convex portion 35*b*1 is located on the moving locus of the coupling convex portion 35*a*1 in the circumferential direction.

Thereby, the clutch 35 has a relative idling area Ec, which is set in correspondence to the circumferential width Ea of the coupling convex portion 35*a*1 of the coupling part 35*a* and the circumferential width Eb of the coupled convex portion 35*b*1 of the coupled part 35*b*.

The idling area Ec corresponds to a maximum moving distance of the coupling convex portion 35*a*1 and the coupled convex portion 35*b*1 in the circumferential direction.

At a state where the rotation of the coupling part 35*a* stops, the coupled part 35*b* is rotatable in the idling area Ec, and at a state where the rotation of the coupled part 35*b* stops, the coupling part 35*a* is rotatable in the idling area Ec.

The coupling convex portion 35*a*1 of the coupling part 35*a* and the coupled convex portion 35*b*1 of the coupled part 35*b* are contacted or separated at circumferential side surfaces thereof as the coupling part 35*a* and the coupled part 35*b* are relatively rotated in the idling area Ec.

In the meantime, at the state where the coupled part 35*b* is rotatable, loads corresponding to frictions, which are to be generated at the respective parts such as friction between the feeding gear shaft 34*b* and a part (e.g., bearing being not shown) supporting the feeding gear shaft 34*b* and friction due to the meshing between the feeding small gear 34*a* and the second feeding gear 30L, are generated.

Since the loads corresponding to the frictions are generated, the load of the feeding motor 33, which is to be applied to the wire W via the first feeding gear L, is not equal to zero. However, since the clutch 35 is provided, the load is reduced. In the meantime, the load due to the friction and the like is sufficiently lower than a load causing the feeding motor 33 to rotate. Therefore, it can be said that the load is removed as the clutch 35 is provided.

By the above configuration, the clutch 35 transmits the drive force of the feeding motor 33 to the first feeding gear 30L, and is rotatable the first feeding gear 30L by a predetermined amount at a state where the driving of the feeding motor 33 is stopped.

That is, the feeding motor 33 is driven, so that the drive force of the feeding motor 33 is transmitted to the coupling part 35*a* by the small gear 33*a* and the large gear 33*b* and the coupling part 35*a* is thus rotated. When the coupling part 35*a* is rotated, the coupling convex portion 35*a*1 of the coupling part 35*a* contacts one side surface of the coupled convex portion 35*b*1 of the coupled part 35*b*, thereby pushing the coupled convex portion 35*b*1 in the circumferential direction.

Thereby, the coupled part 35*b* is rotated integrally with the coupling part 35*a*. The coupled part 35*b* is rotated, so that the feeding small gear 34*a* is rotated and the first feeding gear 30L meshed with the feeding small gear 34*a* is thus rotated.

In contrast, at the state where the driving of the feeding motor 33 is stopped, when a force of rotating the first feeding gear 30L is applied by manual feeding of the wire W, a force of rotating the feeding small gear 34*a* meshed with the first feeding gear 30L is applied. When the force of rotating the feeding small gear 34*a* is applied, the coupled convex portion 35*b*1 of the coupled part 35*b* is separated from one side surface of the coupling convex portion 35*a*1 of the coupling part 35*a*. Thereby, the first feeding gear 30L is rotatable within a range of the idling area Ec.

That is, the coupling part 35*a* provided at the transmission shaft-side of the large gear 33*b*, to which the drive force is to be transmitted from the feeding motor 33, is contacted to or separated from the coupled part 35*b* mounted to the feeding gear shaft 34*b*. Therefore, at the state where the coupling part 35*a* is separated from the coupled part 35*b*, the coupling part 35*a* and the feeding gear shaft 34*b* (the coupled part 35*b*) provided at the first feeding gear 30L-side can idle relative to each other. The idling area Ec between the coupling part 35*a* and the coupled part 35*b* is set to a rotation amount in which one side surface of the coupling part 35*a* and the coupled part 35*b* is separated from the contact position and rotates by a predetermined amount and the other side surface is contacted during the relative rotation.

Therefore, since the first feeding gear 30L is rotatable within the rage of the idling area Ec, it is easy to mount the wire on the wire feeding unit 3A by hand.

Subsequently, a configuration of separating the first feeding gear 30L and the second feeding gear 30R so as to easily and securely mount the wire W is described. The wire feeding unit 3A is configured so that the first feeding gear 30L and the second feeding gear 30R can be displaced in directions of separating from each other and coming close to each other so as to sandwich the wire W between the first feeding gear 30L and the second feeding gear 30R and to mount the wire W between the first feeding gear 30L and the second feeding gear 30R. In this example, the second feeding gear 30R, to which the drive force of the feeding motor 33 is transmitted via the first feeding gear 30L and the drive force of the feeding motor 33 is not directly transmitted, is displaced relative to the first feeding gear 30L.

Therefore, the wire feeding unit 3A includes a first displacement member 36 configured to displace the second feeding gear 30R in the directions of coming close to and separating from the first feeding gear 30L. Also, the wire feeding unit 3A includes a second displacement member 37 configured to displace the first displacement member 36.

The first displacement member 36 is an example of the support part, and the second feeding gear 30R is rotatably supported to one end portion thereof by a shaft 300R. Also, the other end portion of the first displacement member 36 is supported to a support member 301 so that the first displacement member is rotatable about a shaft 36*a* which is a support point.

The shaft 36*a* of the first displacement member 36 is a support point of the rotating operation and is parallel with the shaft 300R of the second feeding gear 30R. Thereby, the first displacement member 36 is configured to be displaced in directions denoted with arrows V1, V2 by a rotating operation about the shaft 36*a* which is a support point, thereby enabling the second feeding gear 30R to come close to or to separate from the first feeding gear 30L.

The first displacement member 36 has, at one end portion-side, a pressed part 36*b* that is to be pressed from the second displacement member 37. The pressed part 36*b* is provided at a side of the shaft 300R of the second feeding gear 30R.

The second displacement member 37 is supported to the support member 301 of the wire feeding unit 3A so that the second displacement member is rotatable about a shaft 37*a*, which is a support point. Also, the second displacement member 37 has a pressing part 37*b* provided at one end portion-side with the shaft 37*a* being interposed therebetween and configured to press the pressed part 36*b* of the first displacement member 36. Also, the second displacement member 37 has a pressed part 37*c* provided at the other end portion-side with the shaft 37*a* being interposed therebetween and configured to be pressed by an operation button (not shown).

The second displacement member 37 is configured to be displaced in directions denoted with arrows W1, W2 by a rotating operation about the shaft 37*a*, which is a support point, thereby enabling the pressing part 37*b* to press the pressed part 36*b* of the first displacement member 36 and the pressed state of the pressed part 36*b* by the pressing part 37*b* to be released.

The wire feeding unit 3A includes a spring 38 configured to press the second feeding gear 30R toward the first feeding gear 30L. The spring 38 is for example, a compression coil spring, and is configured to press the other end portion-side of the second displacement member 37 with the shaft 37*a* being interposed therebetween.

By the pressing of the spring 38, the second displacement member 37 is displaced in the arrow W1 direction by the rotating operation about the shaft 37*a*, which is a support point, so that the pressing part 37*b* presses the pressed part 36*b* of the first displacement member 36. When the pressing part 37*b* of the second displacement member 37 presses the pressed part 36*b* of the first displacement member 36, the first displacement member 36 is displaced in the arrow V1 direction by the rotating operation about the shaft 36*a*, which is a support point. Thereby, the second feeding gear 30R is pressed toward the first feeding gear 30L by the force of the spring 38.

When the wire W is mounted between the first feeding gear 30L and the second feeding gear 30R, the wire W is sandwiched between the groove portion 32L of the first feeding gear 30L and the groove portion 32R of the second feeding gear 30R.

Also, at the state where the wire W is sandwiched between the groove portion 32L of the first feeding gear 30L and the groove portion 32R of the second feeding gear 30R, the tooth part 31L of the first feeding gear 30L and the tooth part 31R of the second feeding gear 30R are meshed with each other.

In contrast, when the second displacement member 37 is applied with a force in a direction of compressing the spring 38 as the pressed part 37*c* is pressed, the pressing part 37*b* is displaced in the arrow W2 direction of separating from the pressed part 36*b* by the rotating operation about the shaft 37*a*, which is a support point.

When the pressing part 37*b* is displaced in the arrow W2 direction of separating from the pressed part 36*b*, the first displacement member 36 can be displaced in the arrow V2 direction by the rotating operation about the shaft 36*a*, which is a support point. Thereby, the second feeding gear 30R can be freely displaced in the direction of separating from the first feeding gear 30L.

In the meantime, although not shown, the wire feeding unit 3A includes an operation button configured to press the pressed part 37*c* of the second displacement member 37, and a release lever configured to lock and unlock the operation button. Therefore, the wire feeding unit 3A is configured to hold the second displacement member 37 in a state where the second displacement member 37 is displaced in the direction of compressing the spring 38.

Subsequently, the wire guide configured to guide the feeding of the wire W is described. As shown in FIG. 2, the first wire guide $\mathbf{4}A_1$ is arranged upstream of the first feeding gear 30L and the second feeding gear 30R with respect to the feeding direction of the wire W to be fed in the forward direction. Also, the second wire guide $\mathbf{4}A_2$ is arranged downstream of the first feeding gear 30L and the second feeding gear 30R with respect to the feeding direction of the wire W to be fed in the forward direction.

The first wire guide $4A_1$ and the second wire guide $4A_2$ have a guide hole 40A through which the wire W is to pass, respectively. The guide hole 40A has a shape for regulating a radial position of the wire W. In the configuration of feeding the two wires W, the first wire guide $4A_1$ and the second wire guide $4A_2$ are respectively formed with the guide hole 40A having a shape through which the two wires W are to pass with being aligned in parallel.

The guide hole 40A of the first wire guide $4A_1$ and the second wire guide $4A_2$ is provided on a feeding path L of the wire W to pass between the first feeding gear 30L and the second feeding gear 30R. The first wire guide $4A_1$ is configured to guide the wire W to pass through the guide hole 40A to the feeding path L between the first feeding gear 30L and the second feeding gear 30R.

A wire introduction part, which is provided upstream of the guide hole 40A with respect to the feeding direction of the wire W to be fed in the forward direction, has a tapered shape of which an opening area is larger at an upstream side than a downstream side, such as a conical shape, a pyramid shape or the like. Thereby, the wire W can be easily introduced into the first wire guide $4A_1$ and the second wire guide $4A_2$.

Subsequently, the curl guide unit 5A configured to form the feeding path of the wire W along which the wire W is to be wound around the reinforcing bars S is described. The curl guide unit 5A includes a first guide (curl guide) 50 configured to curl the wire W, which are being fed by the first feeding gear 30L and the second feeding gear 30R, and a second guide (inductive guide) 51 configured to guide the wire W delivered from the first guide 50 toward the binding unit 7A.

The first guide 50 has a guide groove 52 configuring the feeding path of the wire W, and a first guide pin 53*a* and a second guide pin 53*b* serving as a guide member for curling the wire W in cooperation with the guide groove 52.

The first guide pin 53*a* is provided at an introduction part-side of the first guide 50, to which the wire W being fed by the first feeding gear 30L and the second feeding gear 30R is introduced, and is arranged at a radially inner side of a loop Ru to be formed by the wire W with respect to the feeding path of the wire W configured by the guide groove 52. The first guide pin 53*a* is configured to regulate the feeding path of the wire W so that the wire W being fed along the guide groove 52 do not enter the radially inner side of the loop Ru to be formed by the wire W.

The second guide pin 53*b* is provided at a discharge part-side of the first guide 50, from which the wire W being fed by the first feeding gear 30L and the second feeding gear 30R is discharged, and is arranged at a radially outer side of the loop Ru to be formed by the wire W with respect to the feeding path of the wire W configured by the guide groove 52.

The curl guide unit 5A includes a retraction mechanism 53 configured to retract the first guide pin 53*a*. The retraction mechanism 53 is configured to be displaced in conjunction with the operation of the binding unit 7A after the wire W is wound around the reinforcing bars S, and to retract the first guide pin 53*a* from a moving path of the wire W before the wire W is wound on the reinforcing bars S.

The second guide 51 has a third guide part 54 configured to regulate a radial position of the loop Ru, which is formed by the wire W to be wound around the reinforcing bars S, and a fourth guide part 55 configured to regulate a position along an axial direction Ru1 of the loop Ru, which is formed by the wire W to be wound around the reinforcing bars S.

The third guide part 54 has a wall surface 54*a* that is provided at a radially outer side of the loop Ru, which is formed by the wire W to be wound around the reinforcing bars S, and is configured by a surface extending along the feeding direction of the wire W. When the wire W is wound around the reinforcing bars S, the third guide part 54 regulates a radial position of the loop Ru, which is formed by the wire W to be wound around the reinforcing bars S, by the wall surface 54*a*.

The fourth guide part 55 is provided at an introduction-side of the wire W and has wall surfaces 55*a* that are provided at both sides in the axial direction Ru1 of the loop Ru, which is formed by the wire W to be wound around the reinforcing bars S, and are configured by surfaces erecting from the wall surface 54*a* toward the radially inner side of the loop Ru. When the wire W is wound around the reinforcing bars S, the fourth guide part 55 regulates a position along the axial direction Ru1 of the loop Ru, which is formed by the wire W to be wound around the reinforcing bars S, by the wall surfaces 55*a*.

Thereby, the wire W delivered from the first guide 50 are guided to the third guide part 54 by the fourth guide part 55 while a position of the axial direction Ru1 of the loop Ru to be formed around the reinforcing bars S is regulated by the wall surfaces 55*a* of the fourth guide part 55.

In this example, the second guide 51 is supported to the third guide part 54 at a state where the third guide part 54 is fixed to a main body part 10A of the reinforcing bar binding machine 1A and the fourth guide part 55 can rotate about a shaft 55*b*, which is a support point. The fourth guide part 55 is configured so that an introduction-side, to which the wire W delivered from the first guide 50 is to be introduced, can be opened and closed in directions of separating from and coming close to the first guide 50. Thereby, after binding the reinforcing bars S with the wire W, the fourth guide part 55 is retracted during an operation of pulling out the reinforcing bar binding machine 1A from the reinforcing bars S, so that it is possible to easily perform the operation of pulling out the reinforcing bar binding machine 1A from the reinforcing bars S.

Subsequently, the configuration of curling the wire W is described. The wire W that is fed by the first feeding gear 30L and the second feeding gear 30R is curled as the radial position of the loop Ru to be formed by the wire W is regulated at least at three points of two points of the radially outer side of the loop Ru formed by the wire W and one point of the radially inner side between the two points.

In this example, a radially outer position of the loop Ru to be formed by the wire W is regulated at two points of the second wire guide $4A_2$ provided upstream of the first guide pin 53*a* and the second guide pin 53*b* provided downstream of the first guide pin 53*a* with respect to the feeding direction of the wire W that is fed in the forward direction. Also, a radially inner position of the loop Ru to be formed by the wire W is regulated by the first guide pin 53*a*.

Subsequently, the cutting unit 6A configured to cut the wire W wound around the reinforcing bars S is described. The cutting unit 6A includes a fixed blade part 60, a moveable blade part 61 configured to cut the wire W in cooperation with the fixed blade part 60, and a transmission mechanism 62 configured to transmit an operation of the binding unit 7A to the moveable blade part 61. The fixed blade part 60 has an opening 60*a* through which the wire W is to pass, and an edge portion provided at the opening 60*a* and capable of cutting the wire W.

The fixed blade part 60 is provided downstream of the second wire guide 4$A_2$ with respect to the feeding direction of the wire W that is fed in the forward direction, and the opening 60*a* configures a third wire guide.

The moveable blade part 61 is configured to cut the wire W, which is to pass through the opening 60*a* of the fixed blade part 60, by a rotating operation about the fixed blade part 60, which is a support point. The transmission mechanism 62 is configured to be displaced in conjunction with the operation of the binding unit 7A, and to rotate the moveable blade part 61 in conformity to timing at which the wire W is to be twisted after the wire W is wound on the reinforcing bars S, thereby cutting the wire W.

Figure 7A:
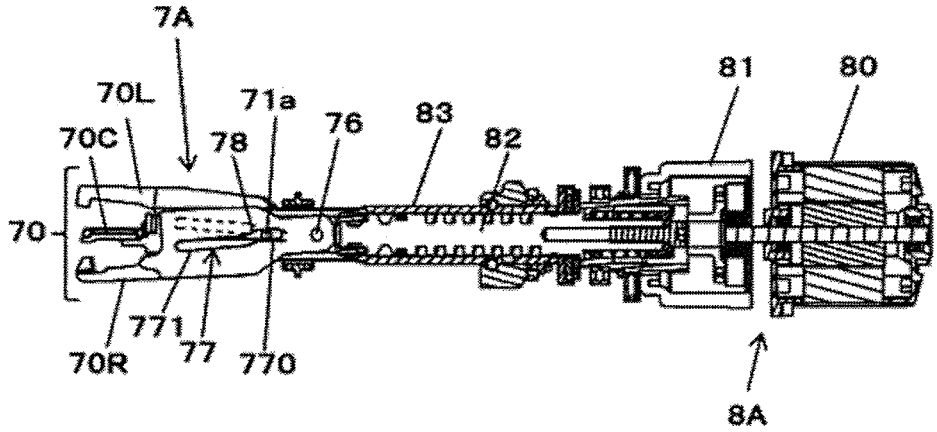
FIGS. 7A and 7B are views depicting an example of a binding unit.
Figure 7B:
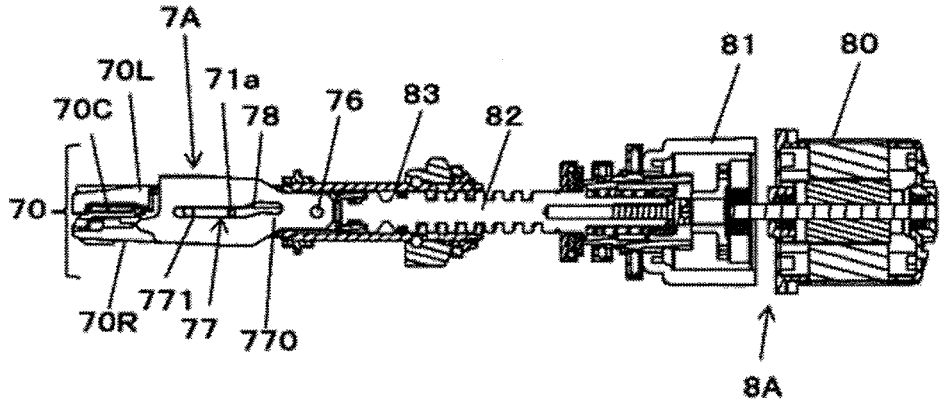
Figure 8:
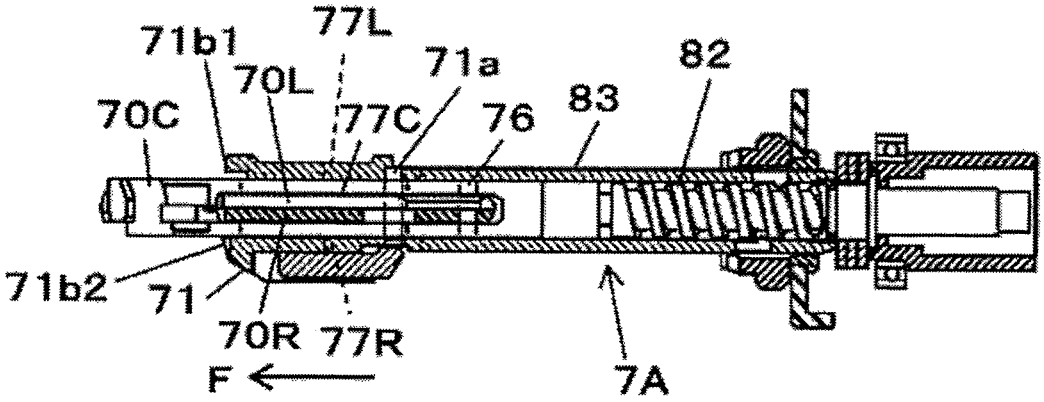
FIG. 8 is a view depicting the example of the binding unit.

FIGS. 7 and 8 depict an example of the binding unit. In the below, the binding unit 7A configured to bind the reinforcing bars S with the wire W is described.

The binding unit 7A includes a gripping part 70 configured to grip the wire W, and a bending part 71 configured to bend one end portions WS and the other end portion WE of the wire W toward the reinforcing bars S.

The gripping part 70 includes a fixed gripping member 70C, a first moveable gripping member 70L, and a second moveable gripping member 70R. The first moveable gripping member 70L and the second moveable gripping member 70R are arranged at left and right sides with the fixed gripping member 70C being interposed therebetween. Specifically, the first moveable gripping member 70L is arranged at one side along the axial direction of the wire W to be wound and the second moveable gripping member 70R is arranged at the other side, with respect to the fixed gripping member 70C.

The first moveable gripping member 70L and the fixed gripping member 70C are configured so that the wire W is to pass between tip ends of the first moveable gripping member 70L and the fixed gripping member 70C. Also, the second moveable gripping member 70R and the fixed gripping member 70C are configured so that the wire W is to pass between tip ends of the second moveable gripping member 70R and the fixed gripping member 70C.

The fixed gripping member 70C has a shaft 76 configured to rotatably support the first moveable gripping member 70L and the second moveable gripping member 70R. The fixed gripping member 70C is configured to support rear ends of the first moveable gripping member 70L and the second moveable gripping member 70R with the shaft 76. Thereby, the first moveable gripping member 70L is opened and closed in directions in which the tip end thereof separates from and comes close to the fixed gripping member 70C by a rotating operation about the shaft 76, which is a support point. Also, the second moveable gripping member 70R is opened and closed in directions in which the tip end thereof separates from and comes close to the fixed gripping member 70C by a rotating operation about the shaft 76, which is a support point.

The bending part 71 has a shape covering a periphery of the gripping part 70 and is provided to be moveable along an axial direction of the binding unit 7A. The bending part 71 has an opening and closing pin 71*a* configured to open and close the first moveable gripping member 70L and the second moveable gripping member 70R. The first moveable gripping member 70L and the second moveable gripping member 70R have an opening and closing guide hole 77 configured to open and close the first moveable gripping member 70L and the second moveable gripping member 70R by an operation of the opening and closing pin 71*a*, respectively.

The opening and closing pin 71*a* passes through an inside of the bending part 71 and is perpendicular to a moving direction of the bending part 71. The opening and closing pin 71*a* is fixed to the bending part 71, and is configured to move in conjunction with movement of the bending part 71.

The opening and closing guide hole 77 extends in a moving direction of the opening and closing pin 71*a*, and has an opening and closing portion 78 configured to convert linear movement of the opening and closing pin 71*a* into an opening and closing operation resulting from the rotation of the second moveable gripping member 70R about the shaft 76, which is a support point. The opening and closing guide hole 77 has a first standby portion 770 extending in the moving direction of the bending part 71 by a first standby distance, and a second standby portion 771 extending in the moving direction of the bending part 71 by a second standby distance. The opening and closing portion 78 extends with being bent obliquely outward from one end portion of the first standby portion 770, and couples to the second standby portion 771. Meanwhile, in FIGS. 7A and 7B, the opening and closing guide hole 77 provided to the second moveable gripping member 70R is shown. However, the first moveable gripping member 70L is also provided with the opening and closing guide hole 77 having a bilaterally symmetric shape.

As shown in FIG. 7A, as the first moveable gripping member 70L and the second moveable gripping member 70R move in the directions of getting away from the fixed gripping member 70C, the gripping part 70 is formed with a feeding path through which the wire W is to pass between the first moveable gripping member 70L and the fixed gripping member 70C and between the second moveable gripping member 70R and the fixed gripping member 70C.

The wire W that is fed by the first feeding gear 30L and the second feeding gear 30R passes between the fixed gripping member 70C and the second moveable gripping member 70R and are guided to the curl guide unit 5A. The wire W curled by the curl guide unit 5A passes between the fixed gripping member 70C and the first moveable gripping member 70L.

A side of the reinforcing bar binding machine 1A at which the curl guide unit 5A shown in FIG. 1 is provided is referred to a front side. When the bending part 71 is moved in a forward direction denoted with an arrow F in FIG. 8 and the opening and closing pin 71*a* thus pushes the opening and closing portion 78 of the opening and closing guide hole 77, the first moveable gripping member 70L and the second moveable gripping member 70R are moved in the directions of coming close to the fixed gripping member 70C by the rotating operation about the shaft 76, which is a support point.

As shown in FIG. 7B, the first moveable gripping member 70L is moved in the direction of coming close to the fixed gripping member 70C, so that the wire W is gripped between the first moveable gripping member 70L and the fixed gripping member 70C. Also, the second moveable gripping member 70R is moved in the direction of coming close to the fixed gripping member 70C, so that a gap in which the wire W can be fed is formed at a portion through which the wire W is to pass between the second moveable gripping member 70R and the fixed gripping member 70C.

The bending part 71 has a bending portion 71*b*1 configured to push one end portion WS of the wire W gripped between the first moveable gripping member 70L and the fixed gripping member 70C. Also, the bending part 71 has a bending portion 71*b*2 configured to push the other end portion WE of the wire W gripped between the second moveable gripping member 70R and the fixed gripping member 70C.

The bending part 71 is moved in the forward direction denoted with the arrow F, so that one end portion WS of the wire W gripped by the fixed gripping member 70C and the first moveable gripping member 70L is pushed by the bending portion 71*b*1 and are thus bent toward the reinforcing bars S. Also, the bending part 71 is moved in the forward direction denoted with the arrow F, so that the other end portion WE of the wire W having passed between the fixed gripping member 70C and the second moveable gripping member 70R are pushed by the bending portion 71*b*1 and are thus bent toward the reinforcing bars S.

As shown in FIG. 2, the binding unit 7A includes a length regulation part 74 configured to regulate positions of one end portion WS of the wire W. The length regulation part 74 is configured by providing a member, to which one end portion WS of the wire W is to be butted, on the feeding path of the wire W having passed between the fixed gripping member 70C and the first moveable gripping member 70L.

Also, the binding unit 7A includes a rotary shaft 82, a moveable member 83, which is an operated member configured to be displaced by a rotating operation of the rotary shaft 82, and a rotation regulation member 84 configured to regulate rotation of the moveable member 83 coupled to the rotating operation of the rotary shaft 82. Also, the reinforcing bar binding machine 1A includes a drive unit 8A configured to drive the binding unit 7A. The drive unit 8A includes a motor 80, and a decelerator 81 for deceleration and torque amplification. The rotary shaft 82 is driven by the motor 80 via the decelerator 81.

The rotary shaft 82 and the moveable member 83 are configured so that the rotating operation of the rotary shaft 82 is converted into movement in a front and back direction along the rotary shaft 82 of the moveable member 83 by a screw part provided to the rotary shaft 82 and a nut part provided to the moveable member 83. The binding unit 7A has the bending part 71 integrated with the moveable member 83, so that the movement of the moveable member 83 in the front and back direction causes the bending part 71 to move in the front and back direction.

In an operation area in which the wire W is gripped by the gripping part 70 and the wire W is bent by the bending part 71, the moveable member 83, the bending part 71, and the gripping part 70 supported to the bending part 71 are engaged with the rotation regulation member 84, and are thus moved in the front and back direction with the rotating operation being regulated by the rotation regulation member 84. Also, when the moveable member 83, the bending part 71 and the gripping part 70 are disengaged from the rotation regulation member 84, they are rotated by the rotating operation of the rotary shaft 82.

The gripping part 70 is configured so that the fixed gripping member 70C, the first moveable gripping member 70L and the second moveable gripping member 70R gripping the wire W is rotated in conjunction with the rotation of the moveable member 83 and the bending part 71.

The retraction mechanism 53 of the first guide pin 53*a* is configured by a link mechanism configured to convert the movement of the moveable member 83 in the front and back direction into the displacement of the first guide pin 53*a*. Also, the transmission mechanism 62 of the moveable blade part 61 is configured by a link mechanism configured to convert the movement of the moveable member 83 in the front and back direction into the rotating operation of the moveable blade part 61.

Subsequently, an operation unit of the reinforcing bar binding machine 1A is described. The reinforcing bar binding machine 1A is used with being gripped by an operator's hand, and has a main body part 10A and a handle part 11A. The handle part 11A is provided at a front side with a trigger 12A. In correspondence to a state of a switch 13A that is pressed when the trigger 12A is operated, a control unit 14A controls the feeding motor 33 and the motor 80. Also, a battery 15A is detachably mounted to a lower part of the handle part 11A.

<Example of Operation of Reinforcing Bar Binding Machine of Embodiment>

Figure 9:
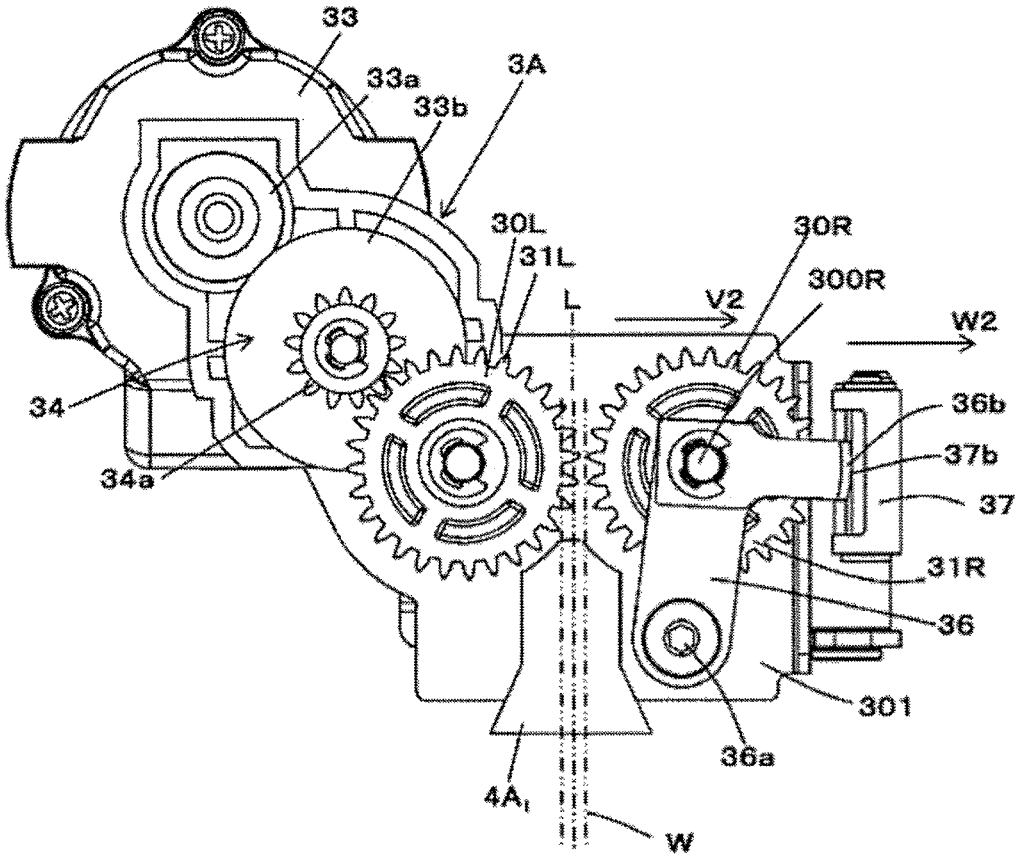
FIG. 9 is a view illustrating an example of a wire mounting operation.

FIG. 9 illustrates an example of an operation of mounting the wires. Subsequently, the operation of mounting the wire W to the reinforcing bar binding machine 1A of the embodiment is described with reference to each drawing.

In an operation of mounting the wire W between the first feeding gear 30L and the second feeding gear 30R, the pressed part 37*c* of the second displacement member 37 shown in FIG. 5 is pushed in the direction of compressing the spring 38 by operating an operation button (not shown). When the second displacement member 37 is applied with the pushing force in the direction of compressing the spring 38, the pressing part 37*b* is displaced in the arrow W2 direction of getting away from the pressed part 36*b* of the first displacement member 36 by the rotating operation about the shaft 37*a*, which is a support point.

When the pressing part 37*b* of the second displacement member 37 is displaced in the arrow W2 direction of getting away from the pressed part 36*b* of the first displacement member 36, the first displacement member 36 can be displaced in the arrow W2 direction by the rotating operation about the shaft 36*a*, which is a support point. Thereby, the second feeding gear 30R can be freely displaced in the direction of getting away from the first feeding gear 30L.

When the wire W is inserted between the first feeding gear 30L and the second feeding gear 30R with the second displacement member 37 being pushed in the direction of compressing the spring 38, the second feeding gear 30R is pushed due to the wire W, so that the second feeding gear 30R is displaced in the direction of separating from the first feeding gear 30L and is retracted from the feeding path L of the wire W, as shown in FIG. 9.

Also, the second feeding gear 30R is displaced in the direction of separating from the first feeding gear 30L, so that the engagement between the tooth part 31L of the first feeding gear 30L and the tooth part 31R of the second feeding gear 30R is released. Thereby, the second feeding gear 30R is rotatable.

The wire guide $\mathbf{4}A_1$ guides the wire W to the feeding path L between the first feeding gear 30L and the second feeding gear 30R. Also, the first feeding gear 30L is not retracted from the feeding path L of the wire W. Thereby, the wire W passing through the wire guide $\mathbf{4}A_1$ and mounted between the first feeding gear 30L and the second feeding gear 30R contact the first feeding gear 30L.

When the wire W is inserted between the first feeding gear 30L and the second feeding gear 30R by manual feeding of the wire W at a state where the driving of the feeding motor 33 is stopped, a force of rotating the first feeding gear 30L by the wire W is applied.

At the state where the driving of the feeding motor 33 is stopped, when the force of rotating the first feeding gear 30L is applied, a force of rotating the feeding small gear 34*a* meshed with the first feeding gear 30L is applied. When the force of rotating the feeding small gear 34*a* is applied, the coupled convex portion 35*b*1 of the coupled part 35*b* is separated from the side surface of the coupling convex portion 35*a*1 of the coupling part 35*a*, so that the first feeding gear 30L is rotatable.

Thereby, during the operation of mounting the wire W between the first feeding gear 30L and the second feeding gear 30R, since the first feeding gear 30L in contact with the wire W is rotatable by the function of the clutch 35, the first feeding gear 30L does not interfere with the mounting of the wire W. Also, the second feeding gear 30R is separated from the first feeding gear 30L and can thus freely rotate. Therefore, since both the first feeding gear 30L and the second feeding gear 30R is rotatable, it is possible to securely mount the wire W to a predetermined position between the first feeding gear 30L and the second feeding gear 30R.

The first feeding gear 30L is rotatable within the range of the idling area Ec of the coupling part 35*a* and the coupled part 35*b* by the function of the clutch 35. A rotatable amount of the first feeding gear 30L in the idling area Ec is set so that the first feeding gear 30L can be rotated after the tip ends of the wire W reach a sandwiching position between the first feeding gear 30L and the second feeding gear 30R until the wire W reach a position at which the wires can be sandwiched between the first feeding gear 30L and the second feeding gear 30R.

After the wire W is mounted between the first feeding gear 30L and the second feeding gear 30R, when the pressing of the second displacement member 37 in the direction of compressing the spring 38 is released, the second displacement member 37 is displaced in the arrow W1 direction through the rotating operation about the shaft 37*a*, which is a support point, by the pressing of the spring 38, and the pressing part 37*b* presses the pressed part 36*b* of the first displacement member 36.

When the pressing part 37*b* of the second displacement member 37 presses the pressed part 36*b* of the first displacement member 36, the first displacement member 36 is displaced in the arrow V1 direction through the rotating operation about the shaft 36*a*, which is a support point. Thereby, the second feeding gear 30R is pressed toward the first feeding gear 30L by the force of the spring 38.

Thereby, the wire W is sandwiched between the groove portion 32L of the first feeding gear 30L and the groove portion 32R of the second feeding gear 30R. Also, the tooth part 31L of the first feeding gear 30L and the tooth part 31R of the second feeding gear 30R are meshed each other with the wire W being interposed between the groove portion 32L of the first feeding gear 30L and the groove portion 32R of the second feeding gear 30R.

In the operation of mounting the two wires W aligned in parallel between the first feeding gear 30L and the second feeding gear 30R, one wire W is contacted to the first feeding gear 30L and the other wire W is contacted to the second feeding gear 30R by the guiding of the wire guide $\mathbf{4}A_1$.

In a configuration where the second feeding gear 30R spaced from the first feeding gear 30L is rotatable but the first feeding gear 30L cannot freely rotate, the other wire W in contact with the second feeding gear 30R can be mounted to a predetermined position but one wire W in contact with the first feeding gear 30L may not be mounted to a predetermined position because the first feeding gear 30L acts as a resistance against the feeding. Therefore, there is a possibility that only one wire W can be fed.

Regarding the above, since the first feeding gear 30L in contact with one wire W can be rotated by the function of the clutch 35 in conjunction with the feeding of the wire W, the first feeding gear 30L does not act as a resistance against the manual feeding of the wire W. Thereby, the two wires W aligned in parallel can be sandwiched between the first feeding gear 30L and the second feeding gear 30R and can be securely mounted to predetermined positions at which the wires can be fed.

FIGS. 10A to 10D illustrate an example of an operation of gripping and twisting the wires in detail. Subsequently, an operation of binding the reinforcing bars S with the two wires W by the reinforcing bar binding machine 1A of the embodiment is described with reference to each drawing.

The reinforcing bar binding machine 1A is in a standby state where the wire W is sandwiched between the first feeding gear 30L and the second feeding gear 30R by the above mounting operation, and the tip ends of the wire W is positioned from the sandwiching position between the first feeding gear 30L and the second feeding gear 30R to the fixed blade part 60 of the cutting unit 6A. Also, as shown in FIG. 7A, when the reinforcing bar binding machine 1A is in the standby state, the first moveable gripping member 70L opens with respect to the fixed gripping member 70C and the second moveable gripping member 70R opens with respect to the fixed gripping member 70C.

When the reinforcing bars S are inserted between the first guide 50 and the second guide 51 of the curl guide unit 5A and the trigger 12A is operated, the feeding motor 33 is driven in the forward rotation direction and the drive force of the feeding motor 33 is transmitted to the first feeding gear 30L via the clutch 35, so that the first feeding gear 30L is rotated in the forward direction and the second feeding gear 30R is also rotated in the forward direction in conjunction with the first feeding gear 30L. Thereby, the two wires W sandwiched between the first feeding gear 30L and the second feeding gear 30R are fed in the forward direction.

The first wire guide $\mathbf{4}A_1$ is provided upstream of the wire feeding unit 3A and the second wire guide $\mathbf{4}A_2$ is provided downstream of the wire feeding unit 3A with respect to the feeding direction of the wire W being fed in the forward direction, so that the two wires W are fed with being aligned in parallel.

When the wire W is fed in the forward direction, the wire W passes between the fixed gripping member 70C and the second moveable gripping member 70R and passes through the guide groove 52 of the first guide 50 of the curl guide unit 5A. Thereby, the wire W is guided (supported) by the second wire guide $\mathbf{4}A_2$, and the wire W is curled to be wound around the reinforcing bars S at two points of the first guide pin 53*a* and the second guide pin 53*b* of the first guide 50.

Figure 10A:
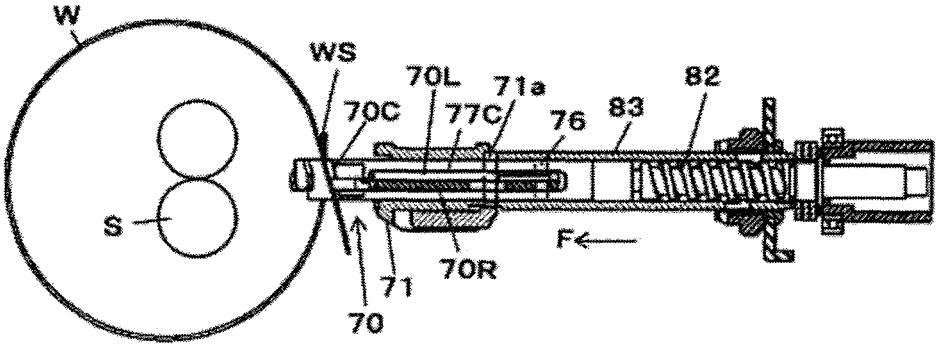
FIGS. 10A to 10D are views illustrating an example of an operation of gripping and twisting wires.

The wire W delivered from the first guide 50 is guided between the fixed gripping member 70C and the first moveable gripping member 70L by the second guide 51. Then, when the tip ends of the wire W is fed to a position at which the tip end is butted to the length regulation part 74, the driving of the feeding motor 33 is stopped. Thereby, as shown in FIG. 10A, the wire W is wound in a loop shape around the reinforcing bars S.

After stopping the feeding of the wire W, the motor 80 is driven in the forward rotation direction, so that the motor 80 moves the moveable member 83 in the arrow F direction, which is a forward direction. That is, a rotating operation of the moveable member 83 coupled to the rotation of the motor 80 is regulated by the rotation regulation member 84, so that the rotation of the motor 80 is converted into the linear movement. Thereby, the moveable member 83 is moved forward.

In conjunction with the forward movement of the moveable member 83, the bending part 71 is moved forward integrally with the moveable member 83, without being rotated. When the bending part 71 is moved forward, the opening and closing pin 71*a* passes through the opening and closing portion 78 of the opening and closing guide hole 77, as shown in FIG. 7B.

Thereby, the first moveable gripping member 70L is moved in the direction of coming close to the fixed gripping member 70C through the rotating operation about the shaft 76, which is a support point. Therefore, one end portion WS of the wire W is gripped between the first moveable gripping member 70L and the fixed gripping member 70C. Also, the second moveable gripping member 70R is moved in the direction of coming close to the fixed gripping member 70C through the rotating operation about the shaft 76, which is a support point. Therefore, a gap in which the wire W can be fed is formed at a portion through which the wire W is to pass between the second moveable gripping member 70R and the fixed gripping member 70C.

Also, when the moveable member 83 is moved forward, the operation of the moveable member 83 is transmitted to the retraction mechanism 53, so that the first guide pin 53*a* is retracted.

After advancing the moveable member 83 to a position at which the wire W is gripped through the opening and closing operation of the first moveable gripping member 70L and the second moveable gripping member 70R, the rotation of the motor 80 is temporarily stopped and the feeding motor 33 is driven in the reverse rotation direction.

When the feeding motor 33 is reversely rotated, the coupling convex portion 35*a*1 of the coupling part 35*a* of the clutch 35 separates from the coupled convex portion 35*b*1 of the coupled part 35*b*. Then, the coupling part 35*a* idles in the idling area Ec, and the coupling convex portion 35*a*1 contacts the coupled convex portion 35*b*1, so that the drive force is again transmitted. Thereby, the first feeding gear 30L is reversed, and the second feeding gear 30R is also reversed in conjunction with the first feeding gear 30L.

Figure 10B:
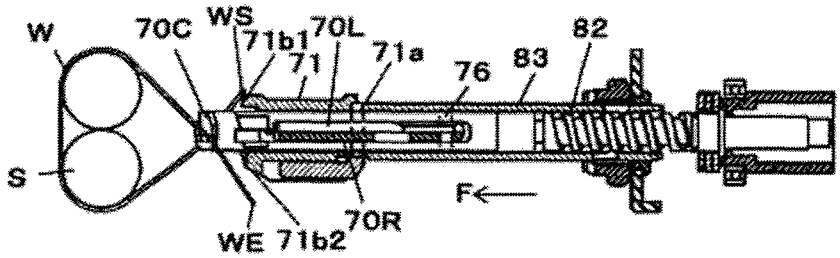

Therefore, the wire S sandwiched between the first feeding gear 30L and the second feeding gear 30R are fed in the reverse direction. During the operation of feeding the wire W in the reverse direction, the wire W is wound on the reinforcing bars S with being closely contacted thereto, as shown in FIG. 10B. In the operation of winding the wire W on the reinforcing bars S by the reverse feeding of the wire W, a rotation amount of the feeding motor 33 is determined, in consideration of the idling area Ec of the clutch 35. Meanwhile, in the operation of feeding the wire W in the forward direction and winding the same around the reinforcing bars S and in the operation of feeding the wire W in the reverse direction and winding the same on the reinforcing bars S, the rotation amount of the feeding motor 33 may be set in correspondence to the idling area Ec so as to feed the wire W by a predetermined amount. Regarding this, the timing at which the feeding motor 33 is to be stopped may be determined from a change in current for driving the feeding motor 33.

After winding the wire W on the reinforcing bars S and stopping the driving of the feeding motor 33 in the reverse rotation direction, the motor 80 is driven in the forward rotation direction, so that the moveable member 83 is moved forward. The forward moving operation of the moveable member 83 is transmitted to the cutting unit 6A by the transmission mechanism 62, so that the moveable blade part 61 is rotated and the other end portion WE of the wire W gripped with the second moveable gripping member 70R and the fixed gripping member 70C are cut by the operation of the fixed blade part 60 and the moveable blade part 61.

When binding the reinforcing bars S with the two wires W, like this example, it is possible to secure the strength equivalent to the case where the reinforcing bars S are bound with one wire even when making a diameter of the respective wire W thinner. For this reason, it is possible to easily bend the wire W and to bring the wire W into close contact with the reinforcing bars S with the lower force. Therefore, it is possible to wind the wire W on the reinforcing bars S with the lower force. Also, it is possible to reduce the load when cutting the wire W. Accompanied by this, it is possible to miniaturize each motor and the mechanism part of the reinforcing bar binding machine 1A, thereby miniaturizing the entire main body part. Also, the motor is miniaturized and the load is reduced, so that it is possible to reduce the power consumption.

Figure 10C:
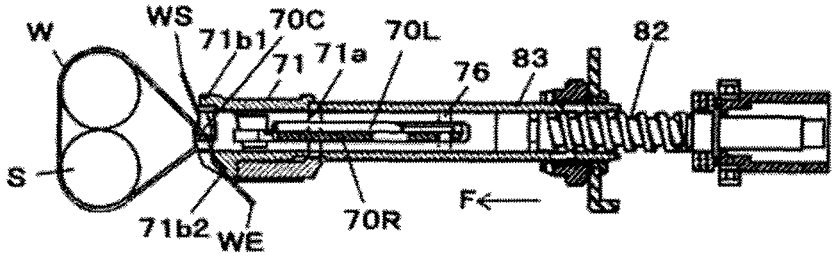

After cutting the wire W, the moveable member 83 is further moved forward, so that the bending part 71 is moved forward integrally with the moveable member 83, as shown in FIG. 10C. The bending part 71 is moved in the direction of coming close to the reinforcing bars S, which is the forward direction denoted with the arrow F, so that one end portion WS of the wire W gripped with the fixed gripping member 70C and the first moveable gripping member 70L is pressed toward the reinforcing bars S by the bending portion 71*b*1, and is bent toward the reinforcing bars S at the gripping position, which is a support point. The bending part 71 is further moved forward, so that one end portion WS of the wire W is held with being gripped between the first moveable gripping member 70L and the fixed gripping member 70C.

Also, the bending part 71 is moved in the direction of coming close to the reinforcing bars S, which is the forward direction denoted with the arrow F, so that the other end portion WE of the wire W gripped with the fixed gripping member 70C and the second moveable gripping member 70R is pressed toward the reinforcing bars S by the bending portion 71*b*2, and are bent toward the reinforcing bars S at the gripping position, which is a support point. The bending part 71 is further moved forward, so that the wire W is supported between the second moveable gripping member 70R and the fixed gripping member 70C.

After bending the end portions of the wire W toward the reinforcing bars S, the motor 80 is further driven in the forward rotation direction, so that the motor 80 further moves the moveable member 83 in the forward direction denoted with the arrow F. The moveable member 83 is moved to a predetermined position in the arrow F direction, so that the moveable member 83 is disengaged from the rotation regulation member 84 and the rotation regulation state of the moveable member 83 by the rotation regulation member 84 is released.

Figure 10D:
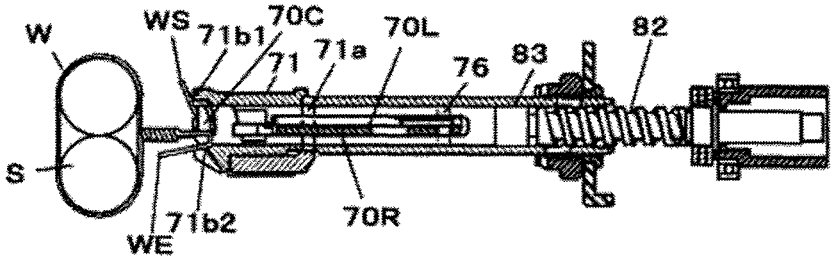

Thereby, the motor 80 is further driven in the forward rotation direction, so that the gripping part 70 gripping the wire W is rotated integrally with the bending part 71 and twists the wire W, as shown in FIG. 10D.

After twisting the wire W, the motor 80 is driven in the reverse rotation direction, so that the motor 80 moves the moveable member 83 in a backward direction denoted with an arrow R. That is, the rotating operation of the moveable member 83 coupled to the rotation of the motor 80 is regulated by the rotation regulation member 84, so that the rotation of the motor 80 is converted into the linear movement.

Thereby, the moveable member 83 is moved backward. As the moveable member 83 is moved backward, the first moveable gripping member 70L and the second moveable gripping member 70R are displaced in the directions of separating from the fixed gripping member 70C, so that the gripping part 70 releases the wire W.

<Modified Embodiments of Reinforcing Bar Binding Machine of Embodiment>

Figure 11:
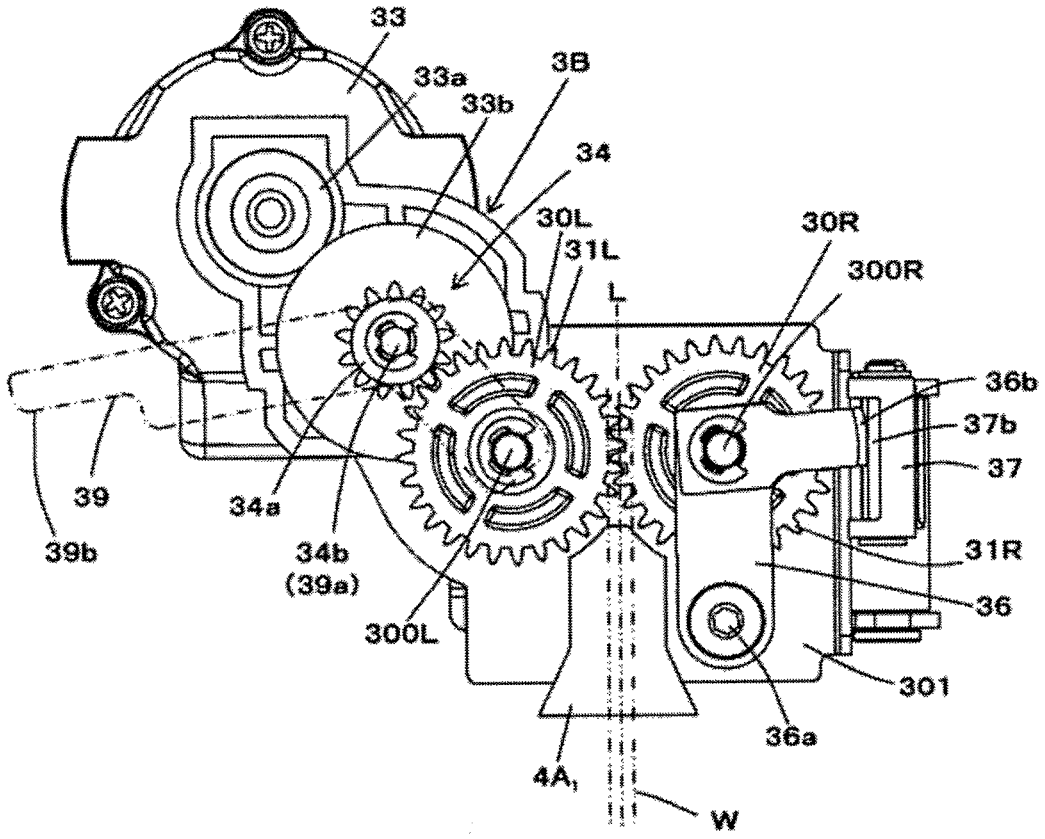
FIG. 11 is a view depicting a wire feeding unit of another embodiment in detail.
Figure 12:
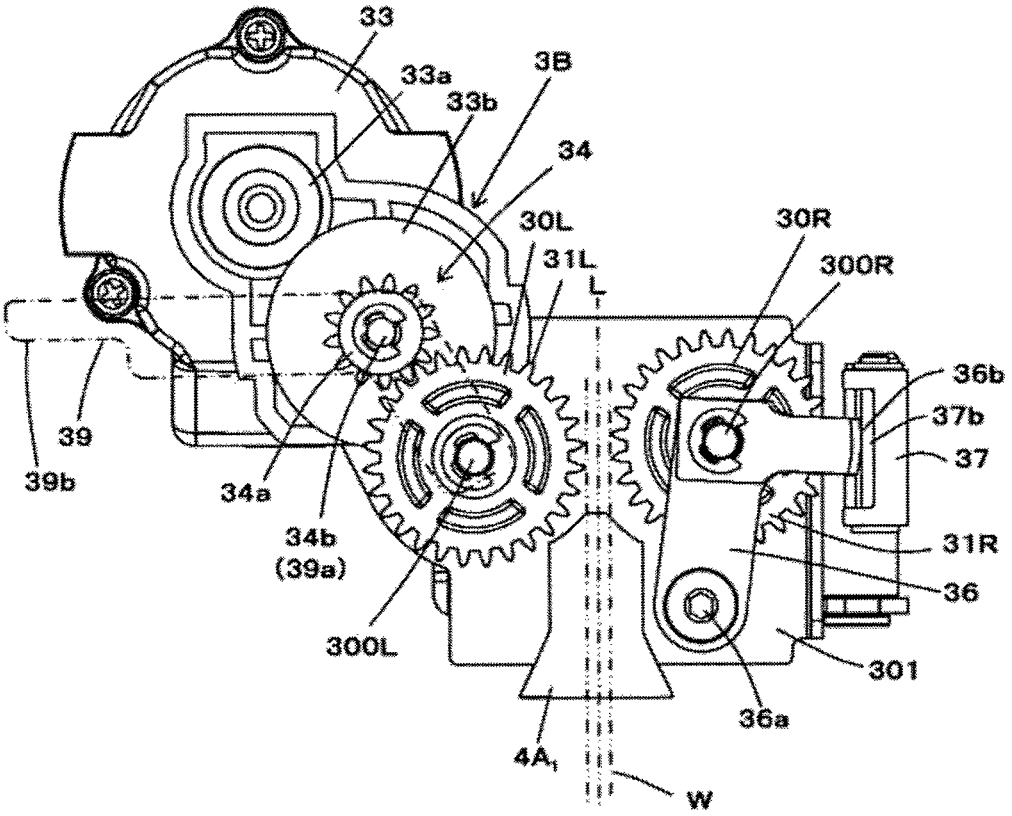
FIG. 12 is a view depicting the wire feeding unit of another embodiment in detail.

FIGS. 11 and 12 depict a wire feeding unit of another embodiment in detail. In the below, another embodiment is described. Meanwhile, in FIGS. 11 and 12, the configurations equivalent to the wire feeding unit 3A described with reference to FIGS. 3 to 6 are denoted with the same reference numerals and the descriptions thereof are omitted.

In a wire feeding unit 3B of another embodiment, the first feeding gear 30L to which the drive force is transmitted from the feeding motor 33 is separated from the second feeding gear 30R, so that the load of the feeding motor 33, which is to be applied to the wire W via the first feeding gear 30L, is reduced or removed.

Therefore, the wire feeding unit 3B includes a displacement member 39 configured to displace the first feeding gear 30L in the directions of coming close to and separating from the second feeding gear 30R. The displacement member 39 is an example of the load reducing part, and is supported to be rotatable about a shaft 39*a* (a support point) coaxial with the feeding gear shaft 34*b* of the feeding small gear 34*a*. The displacement member 39 is configured to support a shaft 300L of the first feeding gear 30L at one end portion with the shaft 39*a* being interposed therebetween. Also, the displacement member 39 has a pressed part 39*b* at the other end portion with the shaft 39*a* being interposed therebetween.

As shown in FIG. 11, the displacement member 39 is configured to sandwich the wire W between the first feeding gear 30L and the second feeding gear 30R and to displace the first feeding gear 30L from the meshing position between the tooth part 31L of the first feeding gear 30L and the tooth part 31R of the second feeding gear 30R to a position at which the first feeding gear 30L separates from the second feeding gear 30R, as shown in FIG. 12. In the meantime, the displacement of the first feeding gear 30L by the displacement member 39 and the displacement of the second feeding gear 30R by the first displacement member 36 may be performed in conjunction with each other.

Since the displacement member 39 is configured to rotate about the shaft 39*a* (a support point) coaxial with the feeding gear shaft 34*b* of the feeding small gear 34*a*, even when the first feeding gear 30L is displaced, there occurs no change in the meshed state between the feeding small gear 34*a* and the first feeding gear 30L.

When the first feeding gear 30L is separated from the second feeding gear 30R, the first feeding gear 30L is retracted from the feeding path L of the wire W. Thereby, the wire W that is guided by the first wire guide $\mathbf{4}A_1$ and is fed between the first feeding gear 30L and the second feeding gear 30R is not contacted to the first feeding gear 30L.

At the state where the wire W and the first feeding gear 30L are not contacted each other, when the wire W is inserted between the first feeding gear 30L and the second feeding gear 30R, the force of rotating the first feeding gear 30L by the manual feeding of the wire W is not applied.

Thereby, during the operation of mounting the wire W between the first feeding gear 30L and the second feeding gear 30R, the first feeding gear 30L does not interfere with the feeding of the wire W. Also, the second feeding gear 30R is separated from the first feeding gear 30L and can thus freely rotate. Therefore, it is possible to securely mount the wire W to a predetermined position between the first feeding gear 30L and the second feeding gear 30R.

During the operation of mounting the two wires W aligned in parallel between the first feeding gear 30L and the second feeding gear 30R, one wire W that is guided by the wire guide $\mathbf{4}A_1$ is not contacted to the first feeding gear 30L. Thereby, the first feeding gear 30L does not act as a resistance against the manual feeding of the wires W, and the two wires W aligned in parallel can be sandwiched and securely mounted to the predetermined position, at which the wires can be fed, between the first feeding gear 30L and the second feeding gear 30R.

Figure 13:
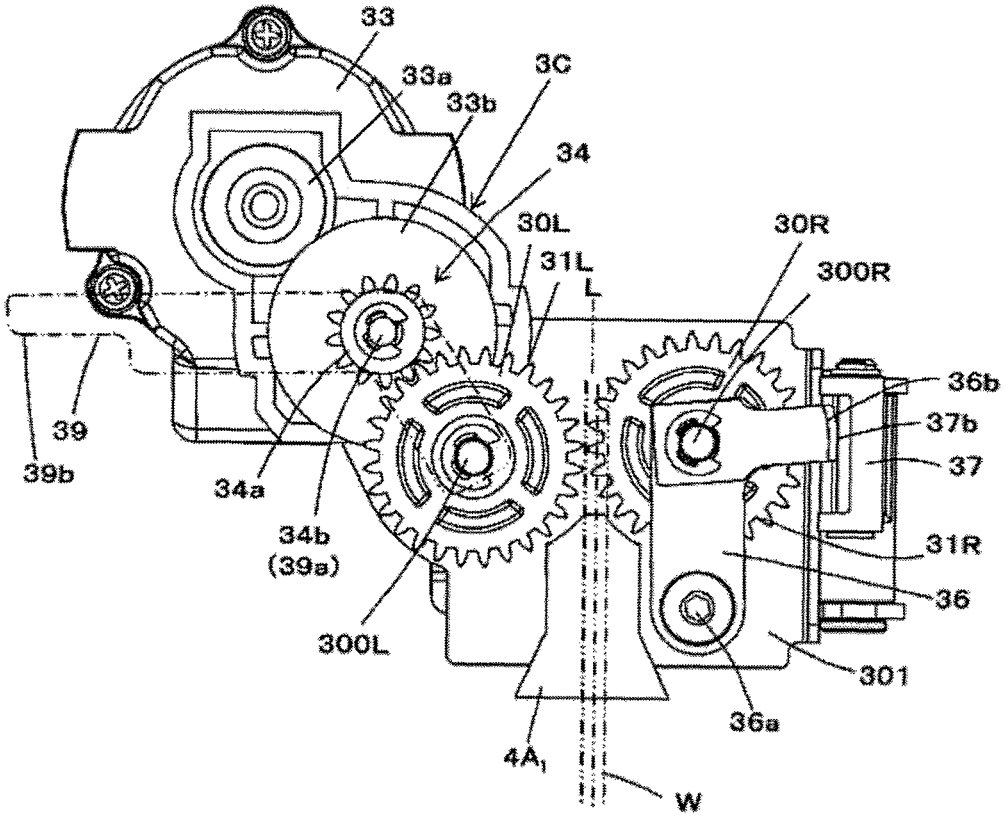
FIG. 13 is a view depicting a wire feeding unit of still another embodiment in detail.

FIG. 13 depicts a wire feeding unit of still another embodiment in detail. In the wire feeding unit 3B of FIGS. 11 and 12, both the first feeding gear 30L and the second feeding gear 30R are configured to be displaced. However, in a wire feeding unit 3C of FIG. 13, only the first feeding gear 30L is displaced by the displacement member 39.

In the wire feeding unit 3C, when the first feeding gear 30L is separated from the second feeding gear 30R by the rotation of the displacement member 39, the first feeding gear 30L is retracted from the feeding path L of the wire W, as shown in FIG. 13. Thereby, the wire W that is guided by the first wire guide $\mathbf{4}A_1$ and is fed between the first feeding gear 30L and the second feeding gear 30R is not contacted to the first feeding gear 30L. Also, the meshed state between the tooth part 31L of the first feeding gear 30L and the tooth part 31R of the second feeding gear 30R is released. Thereby, the second feeding gear 30R is rotatable.

Therefore, during the operation of mounting the wire W between the first feeding gear 30L and the second feeding gear 30R, the first feeding gear 30L does not interfere with the feeding of the wire W, so that it is possible to securely mount the wire W to a predetermined position between the first feeding gear 30L and the second feeding gear 30R. This also applies to the case where the two wires are provided.

DESCRIPTION OF REFERENCE NUMERALS

1A . . . reinforcing bar binding machine, 2A . . . magazine, 20 . . . reel, 3A, 3B, 3C . . . wire feeding unit, 30L . . . first feeding gear (feeding member), 31L . . . tooth part, 32L . . . groove portion, 30R . . . second feeding gear (feeding member), 31R . . . tooth part, 32R . . . groove portion, 33 . . . feeding motor (wire feeding drive unit), 33*a* . . . small gear, 33*b* . . . large gear, 34 . . . drive force transmission mechanism, 34*a* . . . feeding small gear, 34*b* . . . feeding gear shaft, 35 . . . clutch (load reducing part), 35*a* . . . coupling part, 35*a*1 . . . coupling convex portion, 35*b* . . . coupled part, 35*b*1 . . . coupled convex portion, 36 . . . first displacement member (support part), 37 . . . second displacement member, 38 . . . spring, 39 . . . displacement member (load reducing part), 39*a* . . . shaft, $\mathbf{4}A_1$ . . . first wire guide, $\mathbf{4}A_2$ . . . second wire guide, 5A . . . curl guide unit, 50 . . . first guide (curl guide), 51 . . . second guide (inductive guide), 53 . . . retraction mechanism, 53*a* . . . first guide pin, 53*b* . . . second guide pin, 6A . . . cutting unit, 60 . . . fixed blade part, 61 . . . moveable blade part, 62 . . . transmission mechanism, 7A . . . binding unit, 70 . . . gripping part, 70C . . . fixed gripping member, 70L . . . first moveable gripping member, 70R . . . second moveable gripping member, 71 . . . bending part, 71*a* . . . opening and closing pin, 76 . . . shaft, 8A . . . drive unit, 80 . . . motor, 81 . . . decelerator, 82 . . . rotary shaft, 83 . . . moveable member, W . . . wire

The invention claimed is:

1. A binding machine comprising:

a wire feeding unit configured to feed a wire to be wound on an object to be bound, and a binding unit configured to twist the wire wound on the object to be bound, wherein the wire feeding unit comprises:

a pair of feeding members configured to sandwich the wire between the pair of feeding members and to feed the wire by a rotating operation, a wire feeding drive unit connected to one feeding member and configured to rotatively drive the one feeding member, and a load reducing part configured to reduce or remove a load, which is to be applied to the wire via the one feeding member, of the wire feeding drive unit, wherein the load reducing part comprises:

a coupling part connected to the wire feeding drive unit, and a coupled part connected to the one feeding member, the coupling part and the coupled part are contactable and separable with each other, wherein:

when the coupling part and the coupled part are contacted, a drive force of the wire feeding drive unit is transmitted to the one feeding member, the coupling part and the coupled part are arranged coaxially with each other, the coupling part and the coupled part face each other in axial directions thereof, the coupling part has a coupling convex portion formed on a surface facing the coupled part and protruding toward the coupled part, the coupled part has a coupled convex portion formed on a surface facing the coupling part and protruding toward the coupling part, and when the coupling convex portion and the coupled convex portion are contacted, the drive force of the wire feeding drive unit is transmitted to the one feeding member.

2. The binding machine according to claim 1, wherein the load reducing part comprises a clutch configured to cut off a connection between the wire feeding drive unit and the one feeding member, so that the load, which is to be applied to the wire via the one feeding member, of the wire feeding drive unit is reduced or removed.

3. The binding machine according to claim 1, wherein the load reducing part comprises a clutch configured to cut off a connection between the wire feeding drive unit and the one feeding member after a tip end portion of the wire being fed in a forward direction contacts the one feeding member until the tip end portion separates from the one feeding member.

4. The binding machine according to claim 1, wherein the load reducing part comprises a displacement member configured to separate the one feeding member from the other feeding member.

5. The binding machine according to claim 1, further comprising a support part configured to separate the other feeding member from the one feeding member.

6. The binding machine according to claim 1, wherein at a state where a driving of the wire feeding drive unit is stopped, the coupled part is separable from the coupling part and rotatable by a predetermined amount.

7. The binding machine according to claim 1, wherein a circumferential width of the coupling convex portion is narrower than an entire circumference of the coupling part, a circumferential width of the coupled convex portion is narrower than an entire circumference of the coupled part, the coupling convex portion and the coupled convex portion are overlapped with each other in axial and radial directions, and the coupling convex portion is located on a moving locus of the coupled convex portion in circumferential direction and vice versa.

8. The binding machine according to claim 7, wherein a relative idling area is set in correspondence to the circumferential width of the coupling convex portion and the circumferential width of the coupled convex portion.

9. The binding machine according to claim 8, wherein at a state where rotation of the coupling part stops, the coupled part is rotatable in the idling area, and at a state where rotation of the coupled part stops, the coupling part is rotatable in the idling area.

10. The binding machine according to claim 9, wherein a rotatable amount in the idling area is set so that the one feeding member can be rotated after a tip end of the wire being fed in a forward direction reach a sandwiching position between the one feeding member and the other feeding member until the wire reach a position at which the wire can be sandwiched between the first feeding member and the other feeding member.

* * * * *